United States Patent [19]

Nigro, Jr.

[11] Patent Number: 5,054,728

[45] Date of Patent: Oct. 8, 1991

[54] PEGBOARD HANGER

[76] Inventor: Philip Nigro, Jr., 1 Cricket La., Worcester, Mass. 01602

[21] Appl. No.: 581,373

[22] Filed: Sep. 12, 1990

[51] Int. Cl.[5] ..... F16B 17/00

[52] U.S. Cl. ..... 248/220.4; 248/302

[58] Field of Search ..... 248/221.2, 221.1, 220.4, 248/220.3, 302, 311.2

[56] References Cited

U.S. PATENT DOCUMENTS

| | | | |
|---|---|---|---|
| 1,090,897 | 3/1914 | Wernig | 248/302 |
| 2,933,195 | 4/1960 | Radek | 248/221.1 X |
| 3,025,968 | 3/1962 | Snape | 248/220.4 |
| 3,532,318 | 10/1970 | Lloyd | 248/220.4 X |
| 4,143,845 | 3/1979 | Harris | 248/221.2 |

FOREIGN PATENT DOCUMENTS

| | | | |
|---|---|---|---|
| 2758582 | 7/1979 | Fed. Rep. of Germany | 248/220.4 |
| 1125060 | 8/1968 | United Kingdom | 248/220.4 |

*Primary Examiner*—David L. Talbott
*Attorney, Agent, or Firm*—William Nitkin

[57] ABSTRACT

A pegboard hanger having a pair of shoulder members to pass through apertures in the pegboard with a body extending from the shoulder members in front of the pegboard and a neck member on each shoulder member disposed behind the pegboard, such neck members extending at an outward angle to a vertical axis to retain the hanger in the pegboard.

3 Claims, 6 Drawing Sheets

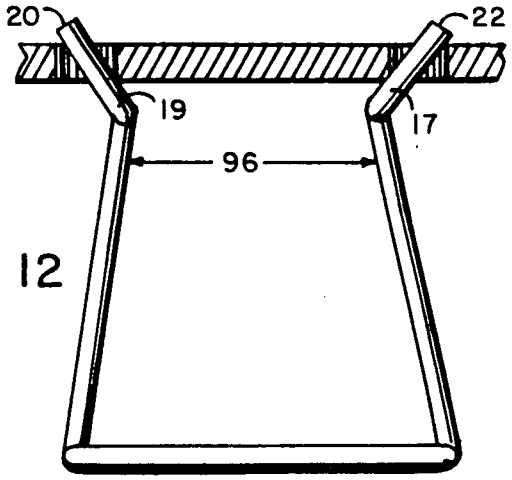
FIG. 12
FIG. 13
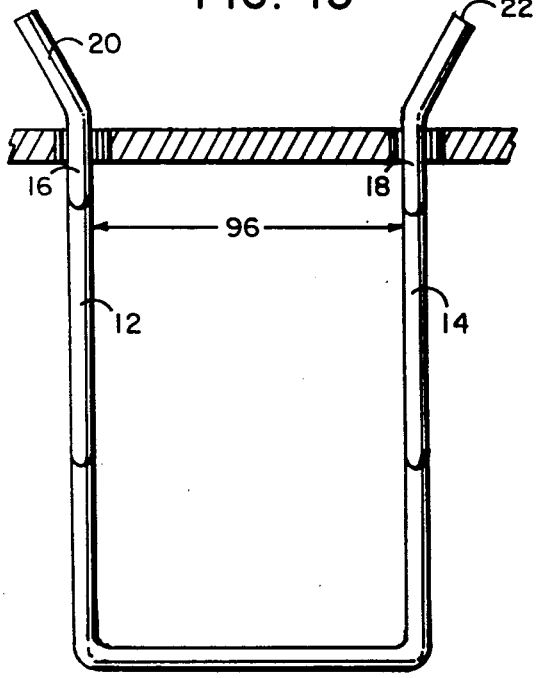
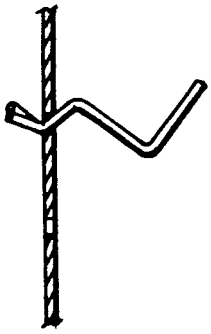
FIG. 13 A
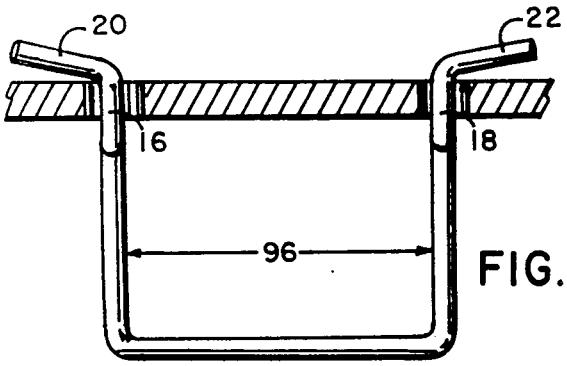
FIG. 14
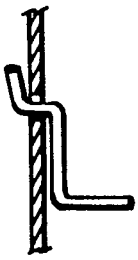
FIG. 14 A

PEGBOARD HANGER

BACKGROUND OF THE INVENTION

1. Field of the Invention

The device of this invention resides in the area of pegboard hangers and more particularly relates to a pegboard hanger that includes structure to prevent its unintentional removal from the pegboard when objects retained thereon are lifted off the hanger.

2. Description of the Prior Art

Pegboards, being perforated boards with a plurality of generally equally spaced-apart apertures, each aperture running from the front surface to the rear surface of the pegboard, such apertures usually arrayed in horizontal rows and vertical columns, are well known. On such pegboards are mounted hangers of various configurations to hold items, such as tools, desired to be retained on the pegboard where they are displayed for easy access. Should one desire to remove an item held on a pegboard hanger, one lifts the item off its hanger and after use returns it to the hanger where it is stored. An often occurring problem in prior art pegboard hangers is that the hangers easily come off the pegboard. Prior art hangers generally include a base on which the item rests and members which pass through apertures in the pegboard which members have rear upwardly extending retention members that retain the hanger on the pegboard. Often when the object held on the hanger is lifted, its removal tends to pull upwards on the hanger which causes the retention members to slide out through the apertures in the pegboard resulting in the hanger falling off the pegboard and requiring the replacement of the hanger on the pegboard.

SUMMARY OF THE INVENTION

It is an object of this invention to provide an improved hanger for use on pegboards which hanger eliminates the prior art problems of the hanger unintentionally coming out of the pegboard. The hanger of this invention includes means to prevent the hanger from being inadvertently removed from the pegboard when objects held on the hanger are removed therefrom.

It is a further object of this invention to provide a hanger with various base member configurations to hold a plurality of different shaped items thereon. The pegboard aperture engagement structure of this invention is adapted so that the hanger will not disengage from the pegboard apertures as objects are lifted therefrom, even if the hanger is lifted upwards.

It is a still further object of this invention to provide a hanger having a pair of upright members generally positioned vertically against the front of the pegboard with inwardly extending shoulder members passing through selected of the pegboard's apertures with a neck member extending from ea:h of the shoulder members, said neck member being disposed at an outward angle from a vertical axis. Each upright member extends down in some embodiments to a leg member which extends generally horizontally inwards toward the opposite upright member, such leg members in some embodiments crossing one over the other and which leg members extend to a base member which base member can be in a variety of configurations as will be described further below. The upright members are positioned somewhat further apart than the distance between the preselected apertures in the pegboard. Thus, in order to align the shoulder members with the pegboard's apertures, the upright members must be maneuvered closer together by manually squeezing them together. The neck members, though, extending from the shoulder members outward from the vertical axis of the upright members, will not be able to pass through the holes, even if the shoulder members are squeezed to be aligned with the apertures. In order to install the hanger, one has to further squeeze the upright member sufficiently together so that the ends of the neck members, each end of which has a diameter narrower than the diameter of the pegboard aperture through which it will pass, will align with the preselected pair of apertures while one lifts the hanger to an almost horizontal position of the upright member to start to engage the ends of the neck members into the apertures. One then passes the neck members into the apertures even though they extend at an outward angle from the vertical axis and gradually passes them through the apertures, lowering the hanger back down to a vertical position of the uprights against the pegboard while at the same time releasing the inward compression on the upright members which steps will allow the neck members to slide at an angle as they are pushed through the apertures. The hanger is then retained in the generally vertical position of the upright members with the outwardly extending base member generally in a horizontal position. When one places an object on the hanger, it is retained thereon until one desires to remove the object. When removed, the object may pull upwards on the base and lift the upright members but the outwardly extending neck members will not pass back through the apertures because they extend outward to either side well beyond the perimeters of the apertures. The only way to remove the hanger of this invention is to deliberately lift it while essentially reversing the steps of hanger installation. The upright members are squeezed together as the clip is lifted upwards toward a horizontal position of the upright members, and the hanger is then pulled away from the apertures so as to cause the neck members to slide through the apertures as the upright members are being compressed together. Thus the hanger can only be removed by deliberate action.

It is felt that this invention represents a significant advance over the prior art in that the hanger cannot be removed merely by lifting an object off the base which, while such action might lift the hanger up a bit, will not compress the upright members together which step is necessary to remove the hanger from the pegboard.

BRIEF DESCRIPTION OF THE DRAWINGS

FIG. 12 illustrates the hanger of FIG. 10 being yet further inserted into the apertures of the pegboard.

FIG. 13 illustrates the hanger of FIG. 10 being still further inserted through the apertures in the pegboard.

FIG. 13*a* illustrates a side view of the embodiment of FIG. 13.

FIG. 14 illustrates a view of the hanger of FIG. 10 fully inserted into the apertures within the pegboard.

FIG. 14*a* illustrates a side view of the embodiment of FIG. 14.

DESCRIPTION OF THE PREFERRED EMBODIMENT(S)

Figure 1:
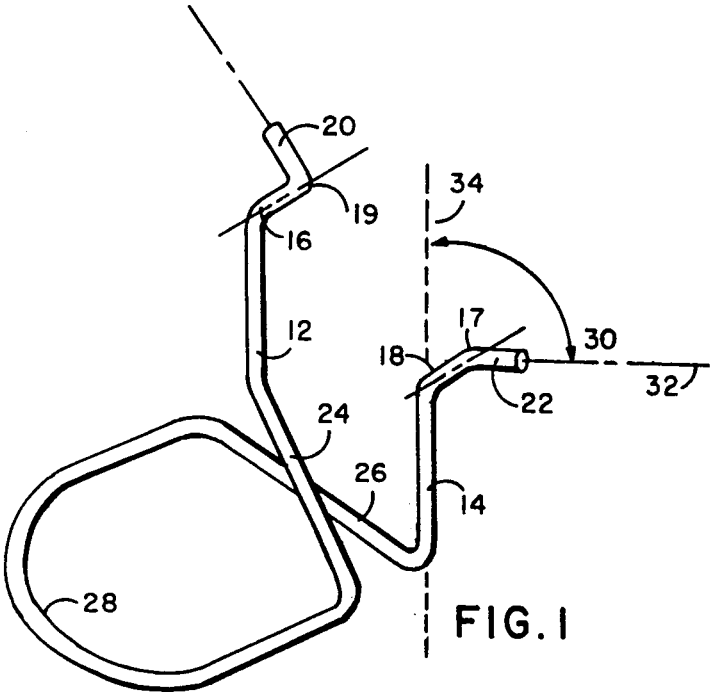
FIG. 1 illustrates a front perspective view of the pegboard hanger of this invention.

FIG. 1 illustrates the basic structure of the pegboard hanger of this invention having first and second upright members 12 and 14 which are generally disposed vertically to the pegboard when installed in position thereagainst. Extending toward the pegboard at the top of and perpendicular to the upright members, are first and second shoulder members 16 and 18. These shoulder members are adapted to pass through selected apertures in the pegboard when the upright members are compressed together but because of the positioning of the upright members when the device is uninstalled, the shoulder members are spaced wider apart from one another than the distance between the pegboard apertures into which they are designed to pass. Extending from the ends of the shoulder members at angle 30 to vertical axis 34 as depicted by dotted lines are first and second neck members 20 and 22 which extend perpendicular to the shoulder members outward at angle 30 approximately 30–45 degrees from vertical axis 34. The neck members each have a smaller diameter than the diameter of the pegboard apertures so they have room to pass therethrough at an angle and this configuration is important to this invention as the neck members retain the hanger in place even when objects retained on the hanger are removed. At the bottom of each upright member, in the embodiment of FIG. 1, can extend first and second leg members 24 and 26, respectively, from first and second upright members 12 and 14. In this embodiment first and second leg members 24 and 26 cross over and under one another and are interconnected by base member 28 which extends outward, curves around and interconnects first leg member 24 to second leg member 26. It should be noted that other structures can form the base of the vertically disposed upright members some of which structures are described in further detail below. The hanger can be made of a resilient material such as metal, plastic or equivalent material bent to the desired form with the upright members disposed somewhat further apart from one another than the distance between the apertures so that the upright members must be manually compressed together during installation of the hanger as described above.

Figure 2:
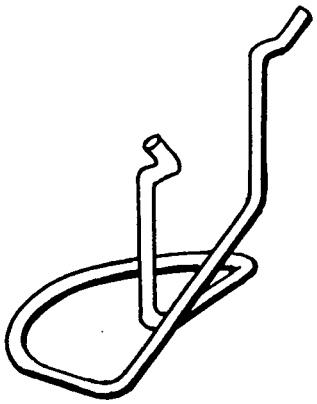
FIG. 2 illustrates a rear perspective view of the device of this invention.

FIG. 2 illustrates a rear Perspective view of the structure of this invention.

Figure 3:
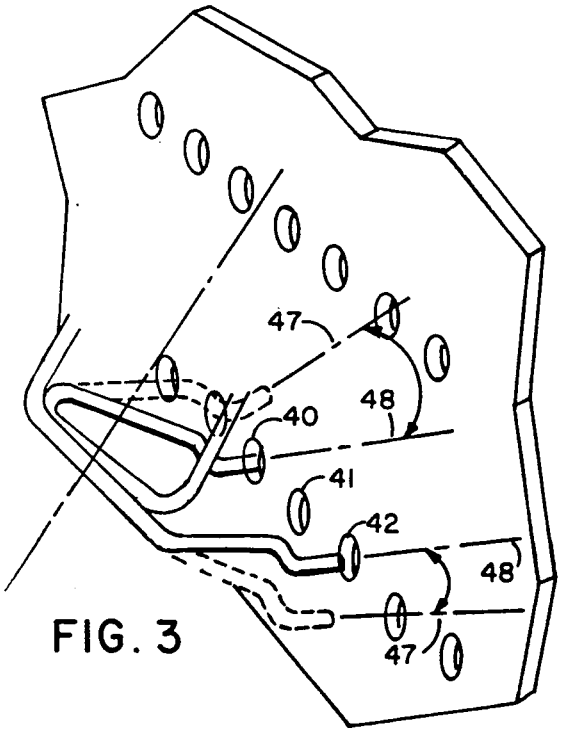
FIG. 3 illustrates a perspective view of the device of this invention in an uncompressed state and in a compressed state for installation on a pegboard.
Figure 4:
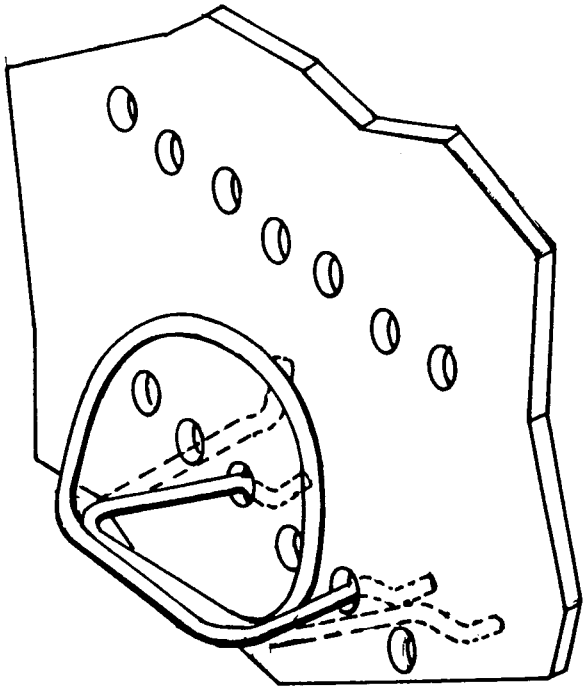
FIG. 4 illustrates the device with its neck members passed through the pegboard apertures.
Figure 5:
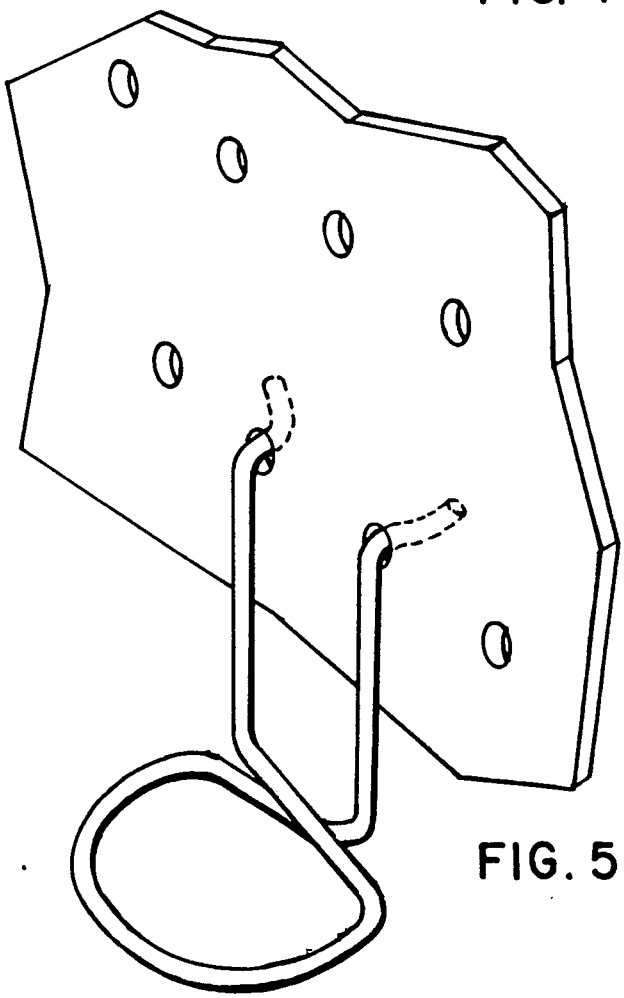
FIG. 5 illustrates the hanger installed on a pegboard with the upright members in a vertical position and the neck members extending at an angle outward beyond the perimeter of the apertures.

FIG. 3 illustrates the structure of this invention during installation of the hanger wherein first and second upright members 12 and 14 are held vertically to the pegboard. They are shown in dotted lines in their uncompressed state before compression, and in solid lines when compressed together to pass through apertures 40 and 42. Once they are compressed together sufficiently so that the ends of the neck members can pass into and through apertures 40 and 42, the upright members are released from compression. The hanger is then engaged through the apertures as seen in FIG. 4 where the upright members are allowed to expand as the neck members pass through the apertures until each neck member passes to the rear of the pegboard behind the desired aperture and the junctions 17 and 19 of the neck members, and the shoulder members are positioned beyond such apertures. The hanger, as seen in FIG. 5, at the same time is rotated downward until the upright members are in a vertical position where they can rest against the pegboard, and the shoulder members are slid all the way into the apertures. In this position the neck members extend outward from a vertical axis aligned with the upright members and even if the hanger were lifted, the neck members could not pass out through the apertures again unless at the same time that the hanger was lifted, the upright members were compressed together continuously to allow the neck members to be withdrawn from the apertures. The upright members must be continuously compressed together as the neck members are withdrawn through the apertures because they project at an outwardly extending angle.

Figure 6:
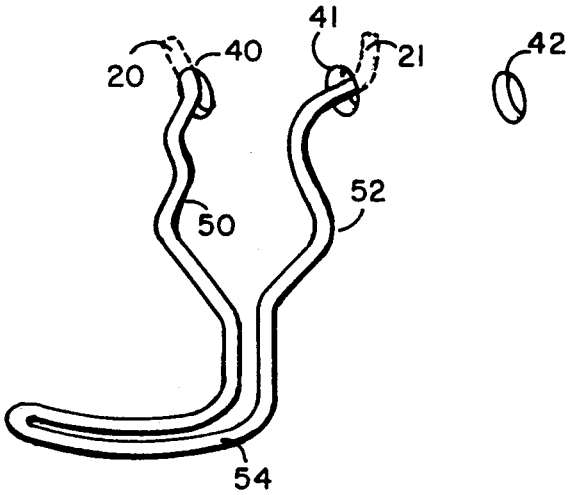
FIG. 6 illustrates an alternate embodiment of the hanger.

FIG. 6 illustrates an alternate embodiment of the device showing the shoulder members passing through pegboard apertures 40 and 41 and extending to first and second upright members 50 and 52 which extend downward and then outward and join one another forming base hook 54. This hanger is structured so that first and second upright members 50 and 52 are disposed in a relaxed state further apart than the distance between apertures 40 and 41, and these upright members, as in the other embodiments, must be compressed in order to engage first and second neck members 20 and 22 into and through apertures 40 and 41.

Figure 7:
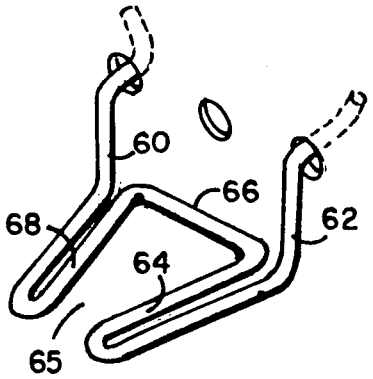
FIG. 7 illustrates an alternate embodiment of the base member.

In an alternate embodiment of the hanger of this invention, FIG. 7 illustrates first and second upright members 60 and 62 which each extend respectively down to outwardly extending first and second projection members 68 and 64 which recurve back and are joined at junction member 66 which is positioned adjacent to the pegboard. This style of hanger can be used when the object to be held on the pegboard is passed into and retained within space 65 between outwardly extending first and second projection members 68 and 64.

Figure 8:
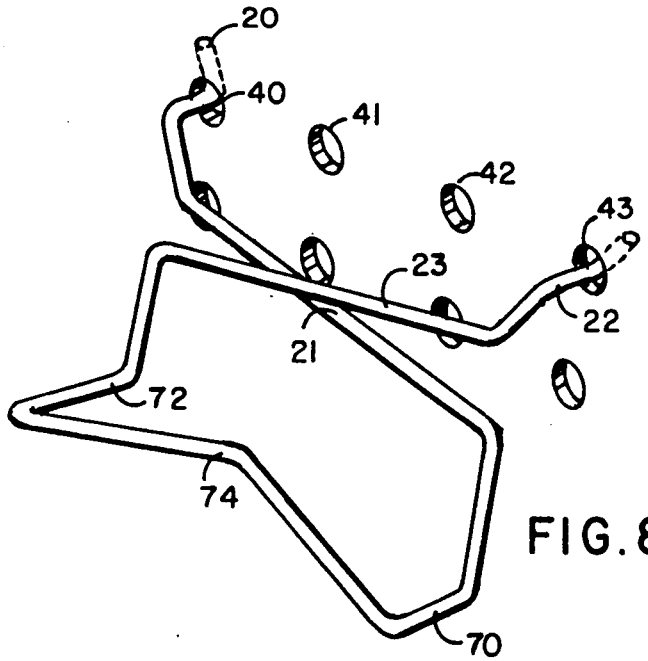
FIG. 8 illustrates a further alternate embodiment of the base member.

FIG. 8 illustrates a further embodiment of the base of the hanger of this invention wherein first and second arm members 21 and 23 continue to downwardly extending first and second extension portions 70 and 72 respectively which are joined by interconnecting portion 74 for the hanging thereon of cords or the like.

Figure 9:
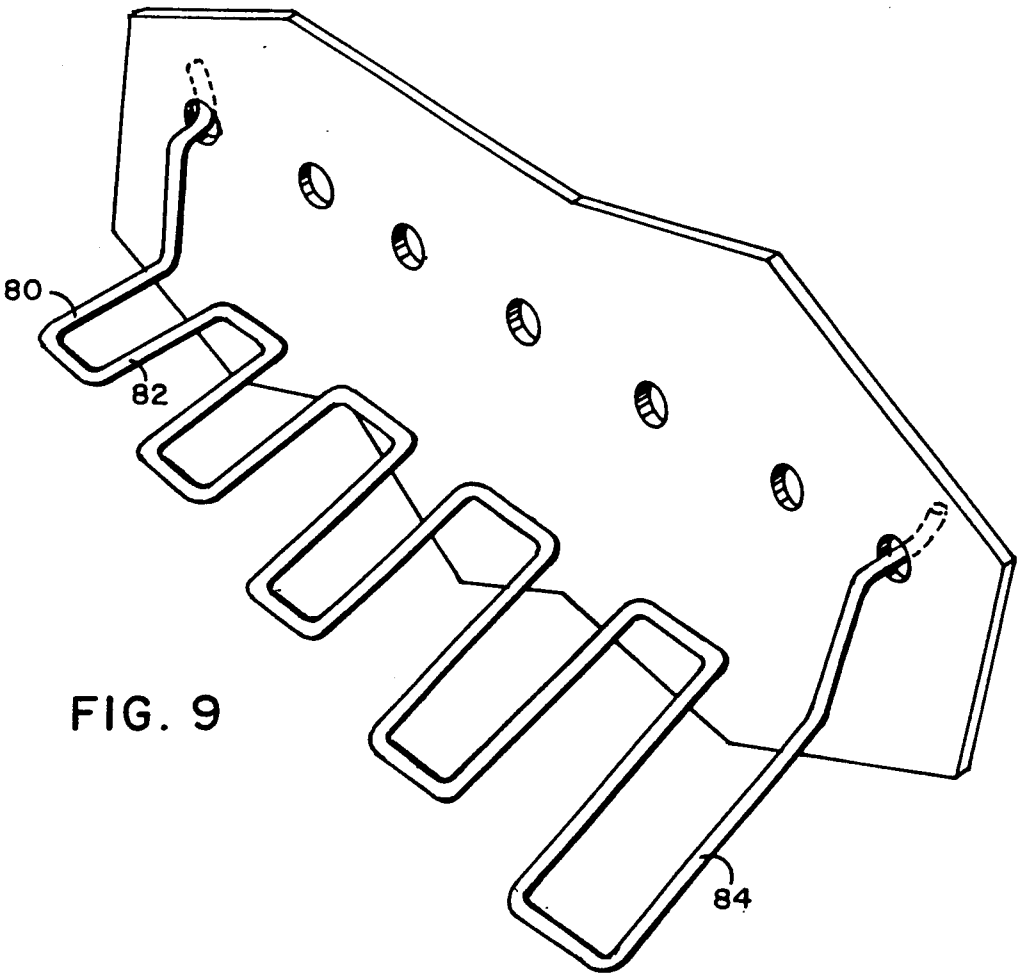
FIG. 9 illustrates yet another alternate embodiment of the base member

FIG. 9 illustrates yet a further embodiment of the device of this invention showing the upright members extending to a series of jogged leg members such as first and second leg members 80 and 84 forming a base plane perpendicular to the pegboard.

Figure 10:
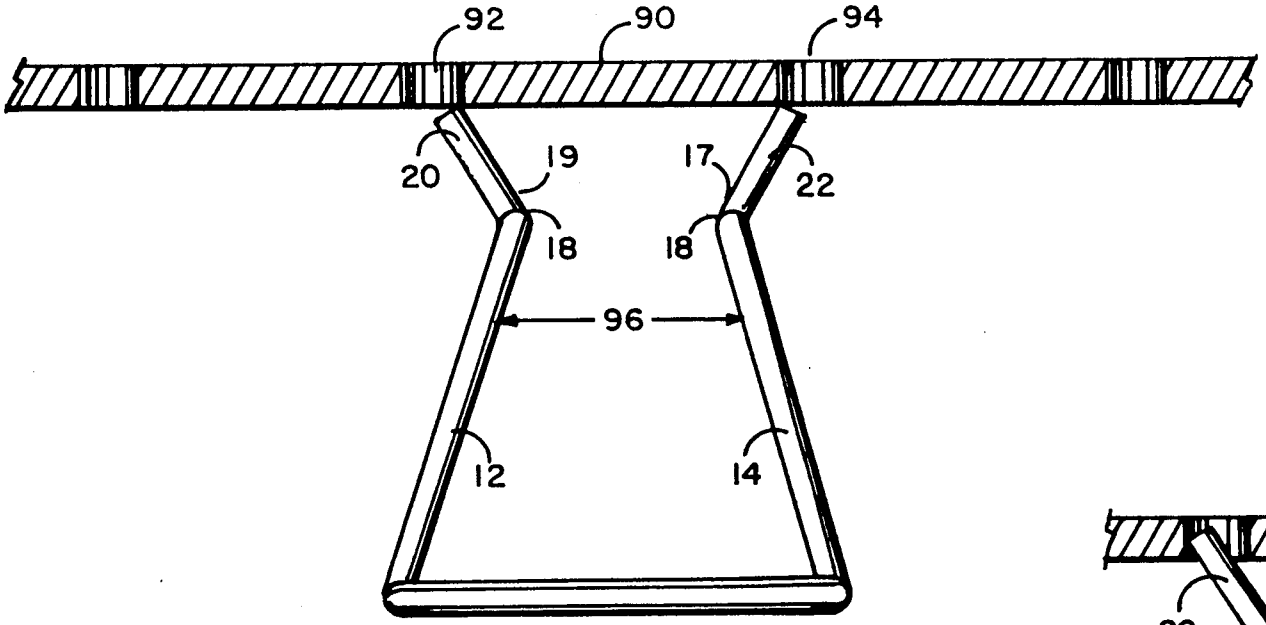
FIG. 10 illustrates a top view of a hanger of this invention being inserted into the apertures of a pegboard.

FIG. 10 is a top view of a hanger of the type of this invention wherein pegboard 90 is seen in cutaway with neck members 20 and 22 about to be inserted into apertures 92 and 94. As can be seen, upright members 12 and 14 have been compressed together a distance 96 so that the ends of neck members 20 and 22 can be entered into the apertures 92 and 94.

Figure 11:
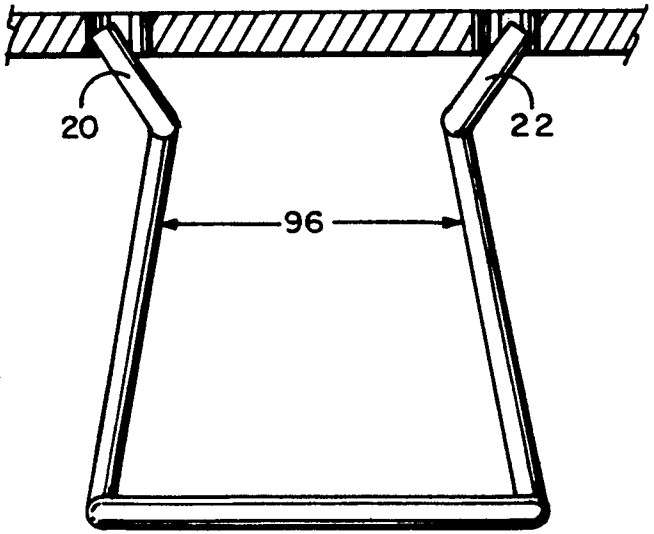
FIG. 11 illustrates the hanger of FIG. 10 being inserted further into the apertures of the pegboard.

FIG. 11 shows a similar view as that of FIG. 10 wherein neck members 20 and 22 have been passed into apertures 92 and 94 and the distance between the upright members 12 and 14 has changed as they are allowed to spread somewhat apart from their compressed state as seen in FIG. 10.

In FIG. 12, which shows a similar view as that of FIG. 11, one can see that neck members 20 and 22 have passed part of the way through the apertures so that their ends protrude beyond the rear of the pegboard while at the same time the distance 96 between the uprights continues to increase as the neck members are allowed to expand further apart.

FIG. 13 shows neck members 20 and 22 fully passed through the apertures and the distance 96 between uprights 12 and 14 further increased although some compression may still be present which tension helps hold the hanger in the pegboard by such outward urging of uprights 12 and 14 against the pegboard.

FIG. 13*a* shows a side view of the hanger of FIG. 13 with the neck members now positioned beyond the rear of the pegboard and the shoulder members now starting their entrance into the apertures.

FIG. 14 shows the shoulder members inserted and lowered to their fully horizontal position and the hanger completely installed with uprights 12 and 14 in a vertical position, as also seen in FIG. 14*a*, and with neck members 20 and 22 seen extending to the side well beyond the outer perimeters of apertures 92 and 94.

It should be noted that although several embodiments of the base member have been illustated, any design of base member can be utilized with the structure of this invention as long as they allow the compression of the upright members to move the shoulder members inwards so that the neck members can be engaged through the pegboard apertures as desired and the base members provide resilient outward pressure thereby urging the upright members in an uncompressed state beyond the outer perimeter of the pegboard apertures.

Although the present invention has been described with reference to particular embodiments, it will be apparent to those skilled in the art that variations and modifications can be substituted therefor without departing from the principles and spirit of the invention.

I claim:

1. An object-holding hanger for positioning on a pegboard having at least one pair of spaced-apart apertures defined therein, said hanger comprising:

base means to retain objects positioned on said hanger;

a pair of spaced-apart shoulder members disposed parallel to one another, each having first and second ends for positioning through two selected apertures;

a pair of support members each having first and second ends, each interconnected at their first ends to said base means and at their second ends to the first ends of said shoulder members respectively, said support members being resiliently biased apart by said base member positioning said shoulder members, when said hanger is in an uncompressed state, further apart than the distance between said selected apertures, said support members being compressible to align said shoulder members individually into said selected apertures; and a pair of neck members of smaller diameter than the diameter of said apertures in said pegboard, each neck member having first and second ends with the first ends of said neck members affixed respectively to the second ends of said shoulder members, said neck members each extending outwardly away from one another in opposite directions, each at an approximately 30–45 degree angle to a vertical axis generally parallel to said support members when said hanger is installed on said pegboard, said hanger when installed in said selected apertures in said pegboard being compressed inwardly sufficiently for the engagement of the oppositely directed second ends of said neck members into said apertures while said neck members are held in a generally horizontal position and maneuvered through said apertures while releasing the inward compression on said support members at the same time as moving said hanger to a generally vertical position when said neck members have passed through said apertures and said shoulder members are positioned in said apertures and wherein the second ends of said neck members are positioned beyond the perimeters of said apertures.

2. The structure of claim 1 wherein said support members comprise first and second upright members.

3. The structure of claim 2 wherein said base member further includes a first leg member and a second leg member each having first and second ends disposed with their first ends interconnected to the ends of said first and second upright members, said first and second leg members extending inwardly from said upright members with one leg member crossing over the other leg member and an interconnection member connecting the second ends of said first and second leg members, said interconnection member compressibly biasing said upright members apart.

* * * * *